US009948030B1

(12) United States Patent
Faulkner

(10) Patent No.: US 9,948,030 B1
(45) Date of Patent: Apr. 17, 2018

(54) LEVER-TYPE ELECTRICAL CONNECTOR BODY AND RELATED ELECTRICAL CONNECTOR ASSEMBLY

(71) Applicant: Phoenix Contact Development and Manufacturing, Inc., Middletown, PA (US)

(72) Inventor: Scott Anthony Faulkner, Harrisburg, PA (US)

(73) Assignee: Phoenix Contact Development and Manufacturing, Inc., Middletown, PA (US)

( * ) Notice: Subject to any disclaimer, the term of this patent is extended or adjusted under 35 U.S.C. 154(b) by 0 days.

(21) Appl. No.: 15/705,397

(22) Filed: Sep. 15, 2017

(51) Int. Cl.

| | |
|---|---|
| ***H01R 13/62*** | (2006.01) |
| ***H01R 13/633*** | (2006.01) |
| ***H01R 13/502*** | (2006.01) |
| ***H01R 13/629*** | (2006.01) |

(52) U.S. Cl.
CPC ..... *H01R 13/6335* (2013.01); *H01R 13/502* (2013.01); *H01R 13/62933* (2013.01)

(58) Field of Classification Search
CPC ..... H01R 13/6335; H01R 13/62938; H01R 13/62933; H01R 13/502; H01R 13/62955
See application file for complete search history.

(56) References Cited

U.S. PATENT DOCUMENTS

| | | | | |
|---|---|---|---|---|
| 5,463,912 | A | 11/1995 | Inoue et al. | |
| 5,641,293 | A | 6/1997 | Tsuji et al. | |
| 6,447,312 | B1 | 9/2002 | Takata | |
| 6,808,401 | B2 | 10/2004 | Guzeldereli et al. | |
| 7,275,943 | B2 | 10/2007 | Ohtaka et al. | |
| 7,329,133 | B2 | 2/2008 | Ishikawa | |
| 7,537,469 | B2 | 5/2009 | Takahashi et al. | |
| 7,670,159 | B2 | 3/2010 | Shamoto et al. | |
| 7,854,619 | B2 | 12/2010 | Takahashi et al. | |
| 8,075,351 | B2 | 12/2011 | Park et al. | |
| 8,215,979 | B2 | 7/2012 | Shamoto et al. | |
| 8,251,761 | B2 | 8/2012 | Shamoto et al. | |
| 8,292,650 | B2 | 10/2012 | Makino et al. | |
| 2007/0173091 | A1* | 7/2007 | Taguchi | H01R 13/62955 439/157 |
| 2007/0293071 | A1* | 12/2007 | Takahashi | H01R 13/62933 439/157 |
| 2008/0081498 | A1* | 4/2008 | Fukatsu | H01R 13/62938 439/157 |
| 2009/0170358 | A1* | 7/2009 | Shamoto | H01R 13/62938 439/157 |
| 2016/0172788 | A1 | 6/2016 | Iida | |

* cited by examiner

*Primary Examiner* — Jean F Duverne
(74) *Attorney, Agent, or Firm* — Hooker & Habib, P.C.

(57) ABSTRACT

A lever-releasable first electrical connector body includes a housing that includes a set of electrical connectors and a lever rotatably mounted in the housing for rotation between retracted and extended positions. When the first connector body is engaged with a second electrical connector body to form electrical connections with the set of electrical connectors, the lever is normally in the retracted position. Rotation of the lever to the extended position causes an end of the lever to engage and urge the second electrical connector away from the first electrical connector.

23 Claims, 6 Drawing Sheets

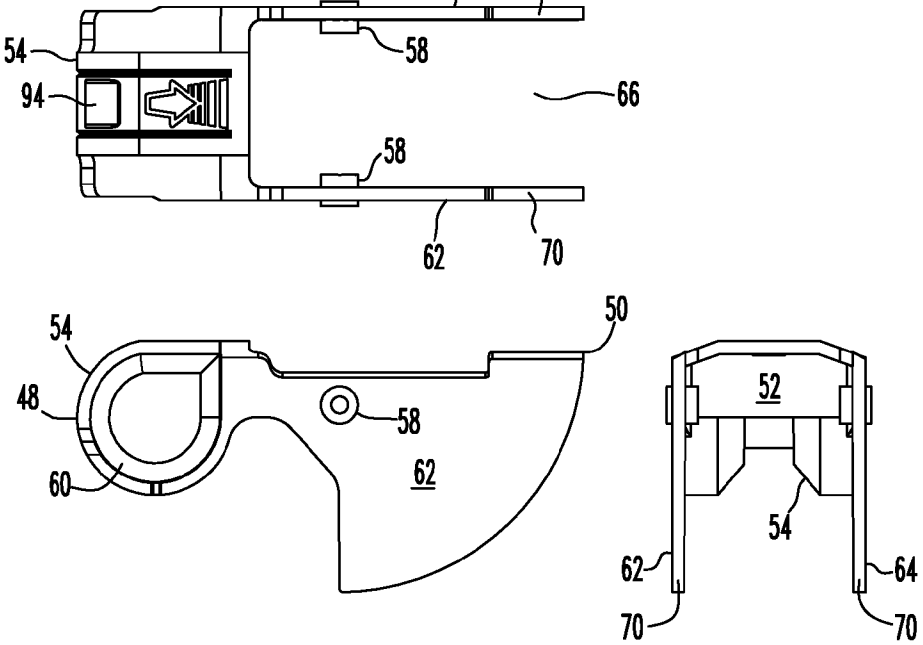
FIG. 9
FIG. 8
FIG. 10
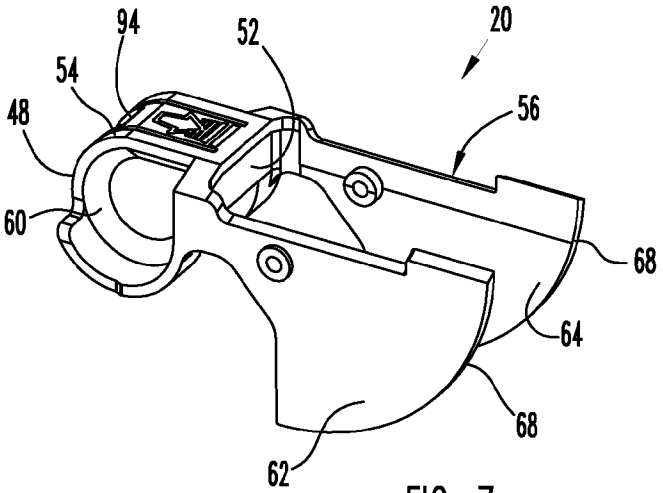
FIG. 7

LEVER-TYPE ELECTRICAL CONNECTOR BODY AND RELATED ELECTRICAL CONNECTOR ASSEMBLY

FIELD OF THE DISCLOSURE

The disclosure relates generally to electrical connector assemblies in which a first electrical connector body housing a set of male or female electrical connectors engages a second electrical connector body housing a corresponding set of the other of the male or female electrical connectors for forming electrical connections between the sets of electrical connectors.

BACKGROUND OF THE DISCLOSURE

Lever-type electrical connector assemblies having a first electrical connector body, a second electrical connector body, and a lever mounted on the first electrical connector body are known. The lever moves in a first direction while connecting the first and second electrical connector bodies so that the lever engages the second electrical connector body and draws the connector bodies together for electrically connecting sets of electrical connectors housed in the bodies. The lever moves in the opposite second direction to force the connector bodies apart for disconnecting the sets of electrical connectors.

The lever is used to both urge the connector bodies together when connecting the sets of electrical connectors, and to force the connector bodies apart when disconnecting the sets of electrical connectors. As a result, the lever construction and the mounting of the lever on the first connector body is relatively complex. Grooves or slots in the lever guide the lever onto the first connector body. The second connector body may also require posts or studs that are received in slots in the lever for moving the connector bodies towards or away from each other.

For many electrical connectors, however, manual connection of the first and second connector bodies is practical and sufficient. Pressing the connector bodies together by hand successfully forms the electrical connections between sets of electrical connectors. Pressing the first connector body against the second connector body can be straightforward even in relatively crowded application environments.

But separating the manually joined connector bodies can be more difficult. Over time, the force required to disengage the sets of electrical connectors may increase due to environmental effects or corrosion.

Thus there is a need for a simplified lever type electrical connector body in which the lever is used only for urging the connector bodies apart when disconnecting the electrical connectors.

Furthermore, many electrical installations include a number of like electrical connector assemblies closely spaced from one another along a DIN rail, inside a cabinet, or the like. Due to the restricted access caused by such close spacing, it is often difficult to manually separate the connector bodies for maintenance or replacement. Electrical connector assemblies used in crowded or dense application environments may have a handle on the front connector body to manually separate the connector bodies. But the force required to initially separate the bodies may be high, making separation difficult even with a handle. Thus there is a further need for a simplified lever-type electrical connector assembly that facilitates separation of closely spaced the connector assemblies.

SUMMARY OF THE DISCLOSURE

Disclosed is a simplified lever-type electrical connector assembly that facilitates separation of the connector assembly even when access is restricted. The disclosed electrical connector assembly includes a first electrical connector body for forming electrical connections with a second electrical connector body that facilitates separation of the first electrical connector body from the second electrical connector body connector assembly even when closely sandwiched side-by-side between like electrical connector assemblies. The first electrical connector body includes a housing, a set of male or female electrical connectors, and a lever. The housing has opposite front and back ends and opposite top and bottom sides, the housing also having a top wall and an opening both disposed at the top side of the housing. The opening is adjacent to the front end of the housing, and a pair of side walls extending from respective sides of the top wall towards the bottom side of the housing. The top wall and the pair of side walls define an interior volume of the housing. The set of electrical connectors are mounted in the interior volume of the housing.

The lever includes axially opposed ends, with a lever handle at one end and a pair of spaced apart, generally planar plates at the other end, each lever plate having an outer peripheral surface.

The lever is rotatably mounted in the housing, the lever rotatable about a pivot axis between angularly spaced apart retracted and extended positions of the lever, the lever plates spaced apart along the direction of the pivot axis.

When the lever is in the retracted position, the lever handle is in the housing adjacent the front end of the housing and is accessible from the housing opening, the lever plates are adjacent the back end of the housing and are closely spaced from respective side walls of the housing, and the set of connectors is disposed between the lever plates and accessible from the bottom side of the housing.

When the lever moves from the retracted position to the extended position the lever plates initially move away from the top side of the housing and towards the bottom side of the housing and the lever handle initially moves towards the top side of the housing and away from the bottom side of the housing.

When the lever moves from the retracted position to the extended position at least a portion of the handle passes through the housing opening and moves outside of the housing, and at least a portion of the peripheral surfaces of the lever plates have moved away from the top wall.

When the first connector body is engaged with the second connector body and forming electrical connections, rotation of the lever from the retracted position to the extended position causes the lever plates to engage the second connector body and urge the connector bodies apart from one another.

The separation between the first and second connector bodies with rotation of the lever is a function of the cam profile of the outer surfaces of the levers that engage the second connector housing. In an embodiment, the sets of electrical connectors only partially disengage when the lever reaches the extended position so that friction between connectors resists falling away of the first connector body from the second connector body. A user can then hold and pull the lever handle along the lever axis to complete the mechanical separation of the sets of electrical connectors.

The disclosed lever releasable first connector body has a number of advantages. Because the lever is not used to draw the connector bodies closer together, construction is simplified and the first connector body can be used even when closely spaced to adjacent connector bodies. The first connector body can be designed to replace or retro-fit existing first connector bodies that are not lever releasable, even in crowded application environments as within a chassis or closely spaced together along a DIN rail.

Other objects, features, and advantages of the disclosure will become apparent as the description proceeds, especially when taken in conjunction with the accompanying drawing sheets illustrating one or more illustrative embodiments.

BRIEF SUMMARY OF THE DRAWINGS

FIGS. 7-10 are perspective, front, top, and end views respectively of the lever of the body shown in FIG. 3.

DETAILED DESCRIPTION

Figure 1:
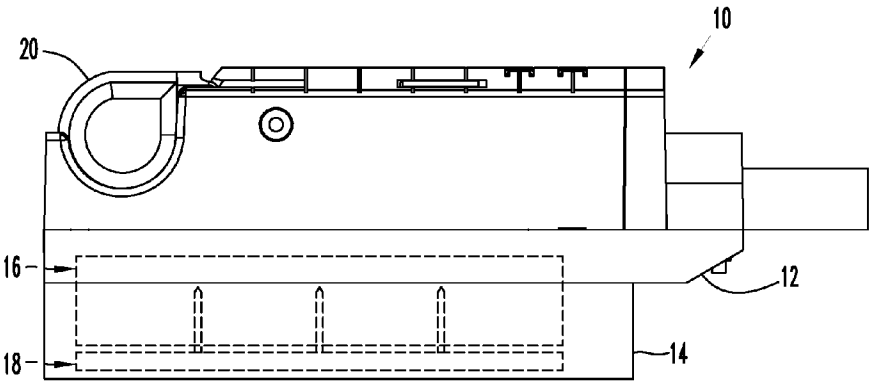
FIG. 1 is a side view of an electrical connector assembly in accordance with this disclosure, the electrical connector assembly in a fully engaged state.
Figure 2:
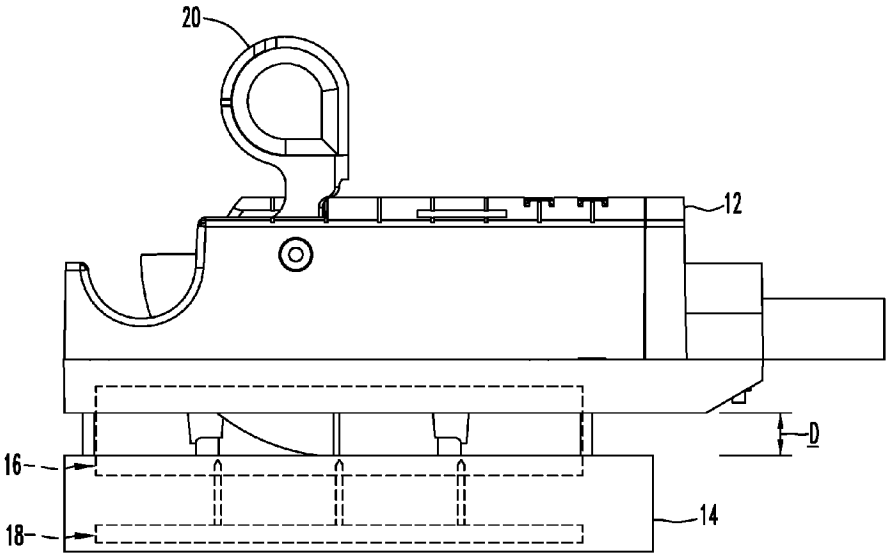
FIG. 2 is similar to FIG. 1 but with the electrical connector assembly in an electrically disconnected state but partially mechanically disconnected state.

FIGS. 1 and 2 illustrate a first embodiment electrical connector assembly 10 that includes a first electrical connector body 12 and a second electrical connector body 14. The first and second connector bodies 12, 14 are shown in FIG. 1 engaged with one another to form electrical connections between respective sets of electrical connectors 16, 18 (shown schematically in dotted lines) carried by the first and second connector bodies 12, 14 respectively.

In the illustrated embodiment the set of electrical connectors 16 is a terminal block having electric terminals and the set of electrical connectors 18 are corresponding pins configured to be received in the terminal block. It is understood that the illustrated sets of electrical connectors are non-limiting and other compatible male and female sets of electrical connectors can be carried in the connector bodies (the terms "male" and "female" referring to compatible sets of electrical connectors intended to inter-engage with one another for forming electrical connections).

In application the second electrical connector bodies 14 are mounted in a cabinet closely spaced from one another and from the sides of the cabinet. The second connector bodies 14 can be manually attached to respective first connector bodies 12. The first connector body 12 includes a release lever 20 that is used in separating the connector bodies 12, 14 and breaking the electrical connections between the sets of electrical connectors 16, 18 despite the restricted access.

FIG. 1 illustrates the connector bodies 12, 14 when joined together to form electrical connections between the sets of electrical connectors 16, 18. The sets of electrical connectors 16, 18 are both fully mechanically and electrically engaged. The lever 20 is in its "closed" or retracted position and does not contact the second connector body 14.

FIG. 2 illustrates the lever 20 moved to an "opened" or extended position, causing the lever 20 to engage the second connector body 14 and move the connector bodies 12, 14 apart by the separation distance D. In the illustrated embodiment when the first and second electrical connector bodies 12, 14 are separated as shown in FIG. 2, the sets of electrical connectors 16, 18 are fully disengaged electrically but are partially engaged mechanically. The electrical connectors no longer form electrical connections between them. The friction generated by the partial mechanical engagement of the electrical connectors resists falling away of the first connector body from the second connector body when mounted vertically in the case but allows low force, full mechanical separation by lightly pulling on the lever handle.

Figure 4:
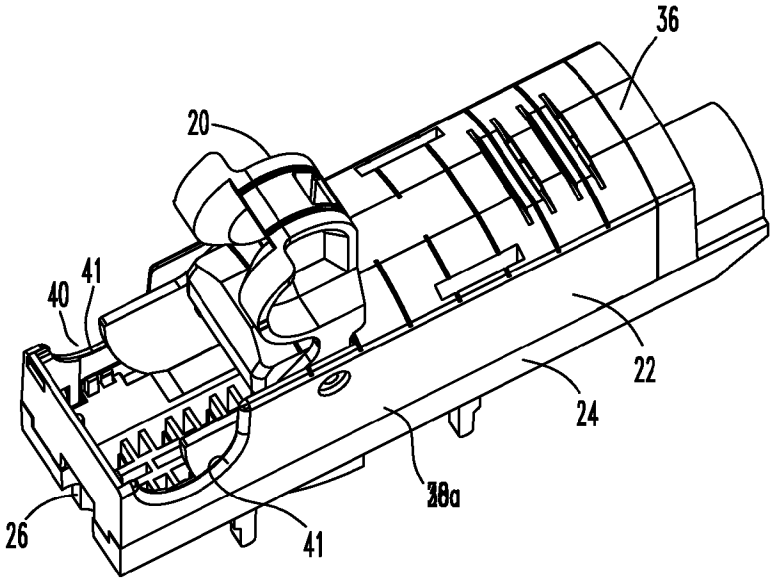
FIG. 4 is a perspective view similar to the view in FIG. 3 but with the body lever in an opened position.
Figure 3:
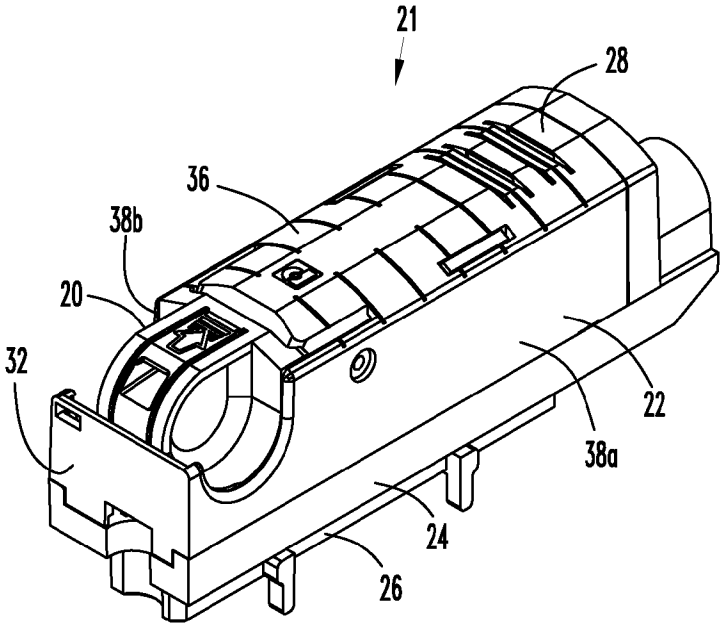
FIG. 3 is a top-front perspective view of the first electrical connector body of the electrical connector assembly shown in FIG. 1, the body lever in a closed position.
Figure 6:
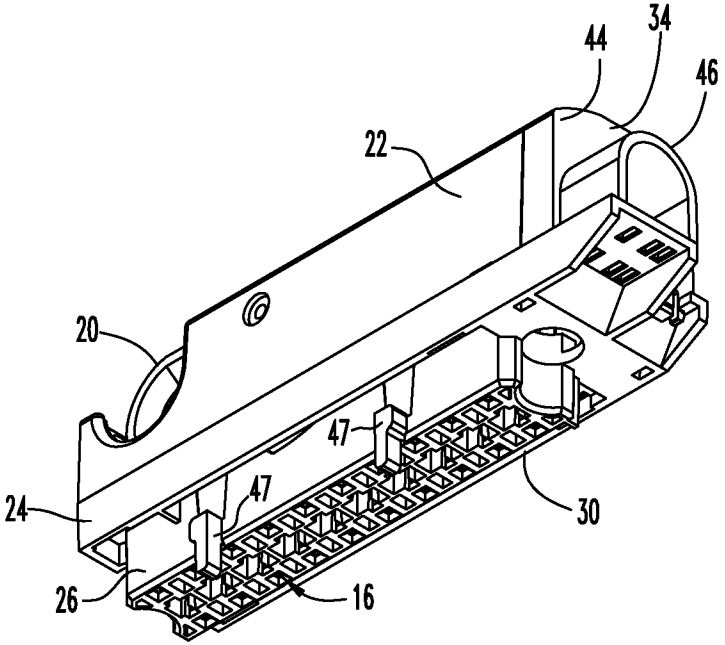
FIGS. 5 and 6 are bottom perspective views of the first electrical connector body shown in FIG. 3.
Figure 5:
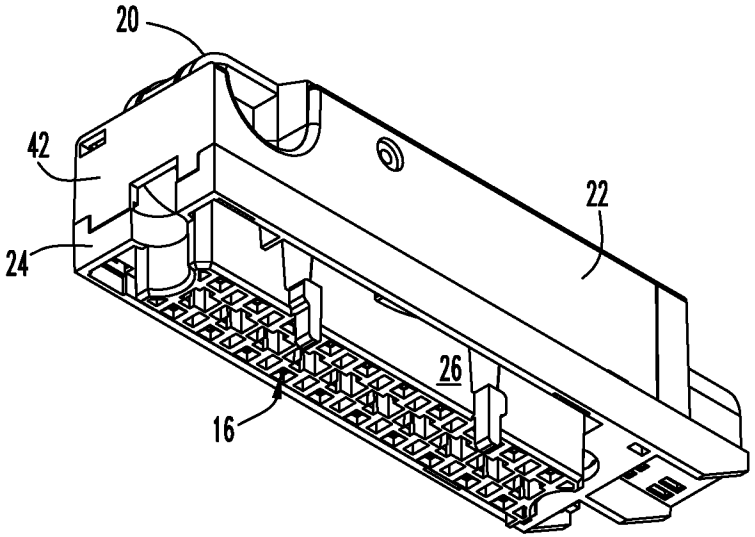

FIGS. 3-6 illustrate the first electrical connector body 12. FIGS. 3, 5, and 6 illustrate the body 12 with the release lever 20 in the closed position. FIG. 4 illustrates the body 12 with the release lever in the opened position.

The first electrical connector body has a housing 21 formed from three components: an upper housing body 22 that mounts the lever 20, a lower housing body 24 that extends from the upper housing body 22 and is pressed against the second connector body 14 when connecting the connector bodies 12, 14 together, and an electrical connector housing 26 that carries the set of electrical connectors 16. The electrical connector housing 26 extends beyond the lower housing body 24 and is received in the second electrical connector housing 14 to form the electrical connections.

The housing 21 includes a top side 28 on an upper side of the upper housing body 22 and an opposite bottom side 30 disposed on the lower side of the lower housing body 24, a front end 32 and an opposite back end 34. The front and back ends 32, 34 respectively of the housing are spaced apart along a longitudinal axis of the body 12.

The upper housing body 22 includes a top wall 36 on the top side of the housing 21 extending from the body back end 34 partway to the body front end 32. A pair of flat, planar side walls 38*a*, 38*b* extend downwardly from the top wall 36 to the bottom side 30. The side walls 38*a*, 38*b* are formed by cooperating side walls of the upper housing 22 and the lower housing 24. The side walls 38*a*, 38*b* are generally flat and extend axially away from the body back end 34, past the top wall 36, to the body front end 32. This leaves an opening 40 defined by curved sided 41 on the top of the upper housing 22. The opening 40 extends from the top wall 36 to the body front end 32.

A front end wall 42 formed from front walls of the upper housing body 22 and the lower housing body 24 is located at the front end of the housing 21. A back end wall 44 is located at the back end of the upper housing 22. The upper housing body 22 defines an interior volume of the housing 21 above the electrical connectors 16 that receives wires W of a cable bundle C through an opening (not shown) in the back end wall, the wires terminating at the electrical connectors 16. See FIG. 13. A cable support 46 supported on an axial extension of the lower housing body 24 guides the cable into the housing 21.

Spaced-apart latches 47 extend downwardly from the lower side of the lower body housing 24 and assist in aligning and engaging the first connector body 12 with the second connector body 14 to form the electrical connector assembly 10.

FIGS. 7-10 illustrate the release lever 20. The lever extends along a lever axis between opposite ends 48, 50 and includes an intermediate body 52 that connects a lever handle 54 at the lever end 48 and a cam assembly 56 at the lever end 50. A pair of coaxial cylindrical trunnions 58 extend perpendicular to the lever axis and define a pivot axis of the lever perpendicular to the lever axis.

The illustrated lever handle 54 is formed generally as a "T" shaped handle. The circular end portions of the cross bar are cut away to expose a recessed, inwardly disposed surface 60 that enable a user to finger-grip the lever from the sides of the handle.

The cam assembly 56 includes a pair of generally planar cam plates 62, 64 that extend parallel with the lever axis from the body 52. The trunnions 58 are each attached to and extend through a respective cam plate 62, 64. The cam plates 62, 64 extend parallel with one another and define a generally uniform width space 66 between the plates. The body 52 and generally like cam plates 62, 64 cooperatively define a U-shaped member enclosing the space 66 that is open at the lever end 50.

Each cam plate 62, 64 has a curved outer peripheral surface 68 that is spaced radially from the pivot axis and extends in the circumferential direction around the pivot axis. The illustrated peripheral surfaces 68 extend about 90 degrees around the pivot axis. The shape of the peripheral surfaces 68 is selected to control and vary the rate of separation of the connector bodies with rotation of the lever. Spaced at an upper end of each cam plate is a flat stop surface 70 that extends inwardly from the lever end 50.

Figure 11:
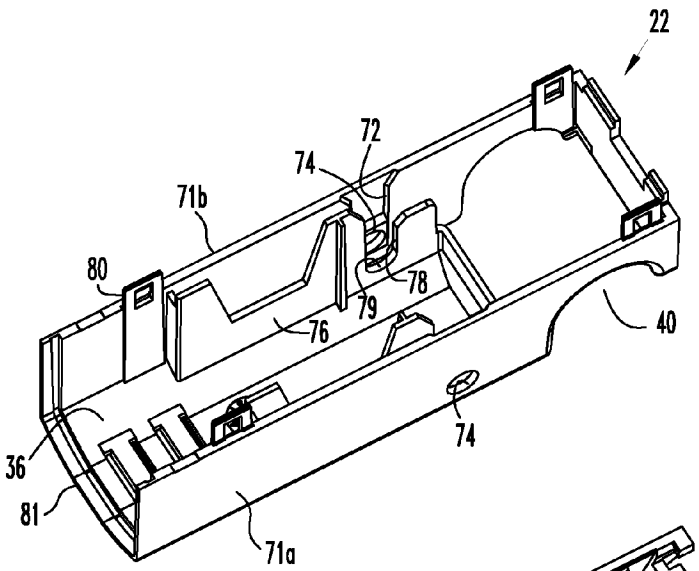
FIG. 11 is a perspective view of the upper body housing of the connector body shown in FIG. 3.

FIG. 11 illustrates the interior of the upper housing body 22, it being understood that the housing 22 is mirror symmetric on both sides of a central plane extending down the middle of the housing body. A pair of side walls 71*a*, 71*b* forming parts of the side walls 38*a*, 38*b* respectively extend from the top wall 36. Formed in the side walls are slots 72 that extend to coaxial trunnion openings 74. Spaced from each side wall is a respective parallel inner wall 76 that extends away from the top wall 36. An open slot 78 with a semicircular closed end 79 formed in each inner wall face the adjacent wall slot 72 and trunnion opening 74. Elongate arms 80 connect the upper housing 22 with the bottom housing 24 when forming the housing 21.

The release lever 20 is mounted in the upper housing body 22. The lever trunnions 58 are received in the slots 78 and the trunnion openings 74. The slot ends 79 and the wall surrounding the trunnion openings 74 cooperate to define trunnion bearings that rotatably mount the trunnions in the upper body housing 22. The trunnion bearings can, in possible embodiments, define interference fits with the trunnions 58 when carrying the trunnions.

The lever cam plates 62, 64 are received between respective pairs of the side walls 71 and the inner walls 76 and extend from the lever body 52 towards the back end 81 of the housing body 22. The cam surfaces 70 face the top side wall 28 and abut the upper wall to define the closed position of the lever. The lever handle 54 is located between the openings 40 when the lever is in the closed position.

Figure 12:
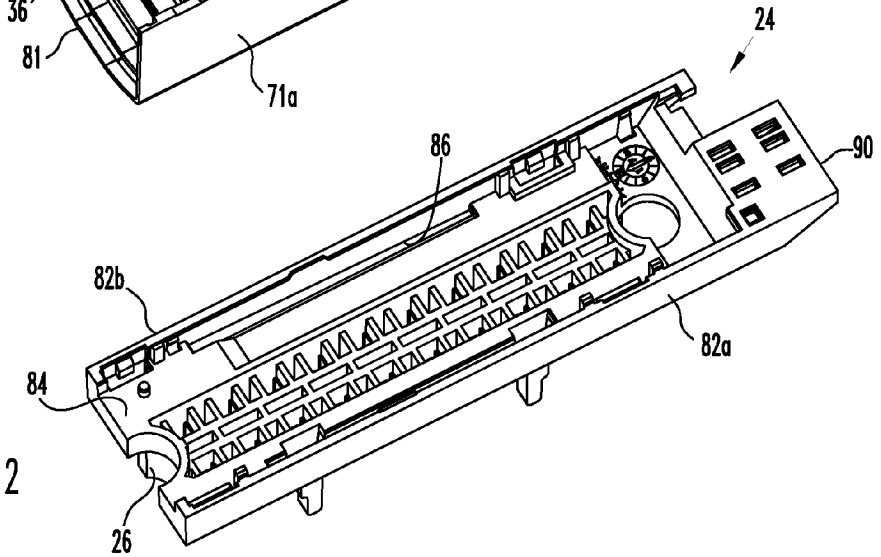
FIG. 12 is a perspective view of the lower body housing of the connector body shown in FIG. 3.

FIG. 12 illustrates the interior of the bottom housing body 24 carrying the electrical connector housing 26. The housing body 24 includes a pair of side walls 82*a*, 82*b* that form part of the side walls 38*a*, 38*b* respectively. A generally flat lower wall or floor 84 extends between the side walls and has an opening that receives and supports the electrical connector housing 26. Formed in the floor adjacent to and extending parallel with each side wall is an elongate through-slot 86. Each through-slot is disposed to receive a respective cam lever 62, 64 in the slot. The housing extension 90 carries the cable support 46 as best seen in FIG. 6.

Figure 13:
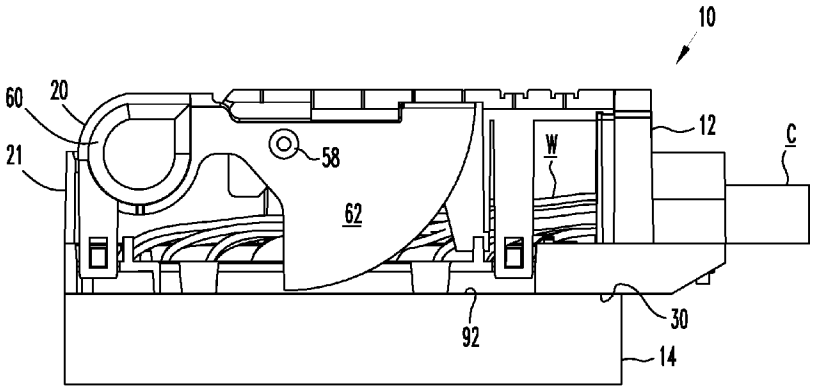
FIG. 13 is a vertical sectional view of the electrical connector assembly in the electrically connected state shown in FIG. 1.

FIG. 13 shows the connector assembly 10 in a fully engaged condition, the lever 20 in the closed position. The lower side 30 of the bottom connector housing 24 is engaged an upper wall 92 of the second electrical connector housing 14. The wires W of the cable bundle C are received into the upper housing body 21 in the gap 66 between the lever cam plates 62, 64. The wires do not interfere with rotational movement of the lever 20. The lever cam plates 62, 64 are completely received within the first electrical connector body 12. The cam plates are closely spaced from the second electrical connector body 14 but do not extend outwardly beyond the bottom side 30 of the first electrical connector housing 21.

Figure 14:
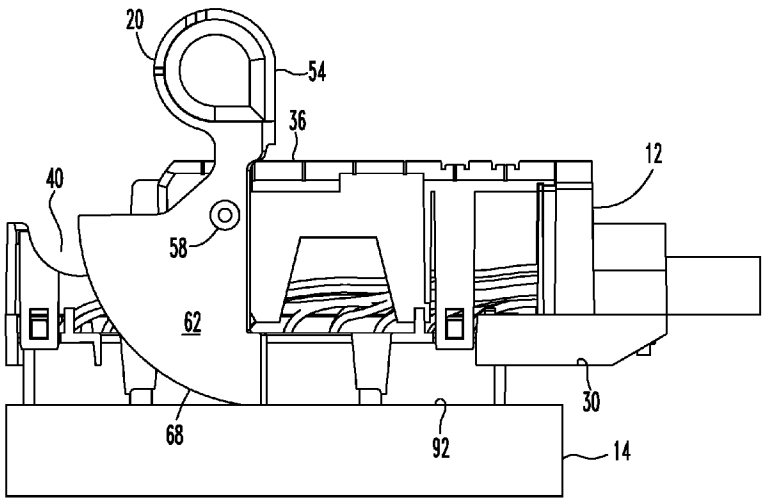
FIG. 14 is a vertical sectional view of the electrical connector assembly in the electrically disconnected state shown in FIG. 2.

Clockwise rotation of the lever 20 as viewed in FIG. 13 moves the lever from its closed position to the opened position shown in FIG. 14. Because of the cutouts 40 and the exposed handle surfaces 60, a user can grasp the sides of the handle 54 to rotate the handle towards the open position even if the connector assembly 10 is in a tightly spaced application. If additional torque is desired to rotate the lever, the lever handle 54 includes an opening 94 (see FIGS. 7 and 9) facing towards the connector body top side 28 that can receive a screwdriver or the like to assist in rotating the lever.

The opened position of the lever 20 is established by the lever handle 54 or the lever body 52 butting against the top wall 36 of the first electrical connector body housing. The handle 54 is outside of the electrical connector body 12. In the illustrated embodiment the lever 20 rotates about 90 degrees between closed and opened positions. Rotation of the lever causes the lever cam plates 62, 64 to increasingly extend outwardly beyond the bottom side 30 of the lower body housing 24 and engage and press against the wall 92 of the second connector body 14.

The lever cam plates 62, 64 act as rotary cams that engage the wall 92 and thus urge the second electrical connector housing 14 and the first electrical connector housing 12 apart. The cam profiles 68 are not concentric with the lever pivot axis but are instead eccentric to enable portions of the cam profile increasingly further away from the pivot axis to emerge from the electrical connector housing 12 as the lever moves from the retracted position to the opened position.

The cam plates rotate about the lever pivot axis defined by the trunnions 58 and perpendicular to the drawing sheet as viewed in FIG. 14. The cam plates rotate in a plane parallel with the separation direction of the connector bodies 12, 14. The outer peripheral surfaces 68 of the lever plates 62, 64 each essentially make point contact with the wall 92, the point contact moving along each peripheral surface 68 with angular displacement of the lever 20 between opened and closed positions.

The cam profiles defined by the cam plate outer peripheral surfaces 68 determine the relative translation or separation of the second electrical connector body 14 with respect to the first electrical connector body 12. The separation distance between the two connector bodies 12, 14 is a function of the rotary position or angle of the lever 20 with respect to the lever's pivot axis.

The lever cam plate profiles 68 can be designed to meet specific requirements. For a non-limiting example, the cam profile could generate a relatively slow separation of the connector bodies during initial rotation of the lever to initiate separation of the sets of electrical connectors and overcome static friction between the engaged pairs of electrical connectors 16, 18. After initial rotation, the cam profiles are designed to accelerate separation during later rotation of the lever. Another non-limiting cam profile design could provide for a constant rate of separation when the lever is rotated at a constant angular velocity.

As described above, the release lever 20 and its cam plates 62, 64 are configured to fully disengage the sets of electrical connectors 16, 18 electrically but only partially disengage the sets of connector bodies 12, 14 mechanically when used to separate the electrical connector assembly 10. The lever 20 in the opened position is essentially parallel with the separation direction and enables a user to hold and apply a light force to the lever handle 54 parallel to the separation direction to complete mechanical separation of the connector assembly 10.

To connect the electrical connector assembly 10 together and form mechanical and electrical connections between the first electrical connector body 12 and the second electrical connector body 14, the first electrical connector body 12 is placed over and aligned with the second electrical connector body 14. The first electrical connector body is then manually pressed against the second electrical connector body. The top wall 36 and the handle 54 of the first electrical connector body can be used to apply force urging the connector bodies together to the fully engaged state shown in FIGS. 1 and 13.

In other possible embodiments of the disclosed electrical connector assembly the second connection housing 14 includes bearing surfaces within the housing 14 that face the cam plates and are engaged by the cam plates 62, 64 during rotation of the lever from the closed to the opened position. The cam plates may extend into the housing 14 to engage the bearing surfaces.

While one or more embodiments have been disclosed and described in detail, it is understood that this is capable of modification and that the scope of the disclosure is not limited to the precise details set forth but includes modifications obvious to a person of ordinary skill in possession of this disclosure, including (but not limited to) changes in material selection, size, operating ranges (temperature, volume, displacement, stroke length, concentration, and the like), environment of use, and also such changes and alterations as fall within the purview of the following claims.

What is claimed is:

1. A lever-releasable first electrical connector body for forming electrical connections with a second electrical connector body, the first electrical connector body comprising:

a housing, a set of male or female electrical connectors, and a lever;

the housing having opposite front and back ends and opposite top and bottom sides, the housing comprising a top wall and an opening both disposed at the top side of the housing, the opening adjacent the front end of the housing, a pair of side walls extending from respective sides of the top wall towards the bottom side of the housing, the top wall and the pair of side walls defining an interior volume of the housing, the set of electrical connectors mounted in the interior volume of the housing;

the lever extending along a lever axis and comprising axially opposed ends, the lever comprising a lever handle at one end and a pair of spaced apart, generally planar plates at the other end, each lever plate comprising an outer peripheral surface;

the lever rotatably mounted in the housing, the lever rotatable about a pivot axis between angularly spaced apart retracted and extended positions of the lever, the lever plates spaced apart along the direction of the pivot axis;

when the lever is in the retracted position, the lever handle is in the housing adjacent the front end of the housing and is accessible from the housing opening, and the lever plates are adjacent the back end of the housing and are closely spaced from respective side walls of the housing;

when the lever moves from the retracted position to the extended position the lever plates initially move away from the top side of the housing and towards the bottom side of the housing and the lever handle initially moves towards the top side of the housing and away from the bottom side of the housing; and when the lever moves from the retracted position to the extended position at least a portion of the lever handle passes through the housing opening and moves outside of the housing, and at least a portion of the peripheral surfaces of the lever plates have moved away from the top wall.

2. The first electrical connector body of claim 1 wherein the said at least a portion of the peripheral surfaces of the lever plates extend outwardly beyond the bottom side of the housing when the lever is in the extended position.

3. The first electrical connector body of claim 1 wherein when the lever moves from the retracted position to the extended position the lever abuts the top wall to define the extended position of the lever and to resist further rotation of the lever away from the retracted position.

4. The first electrical connector body of claim 1 wherein the housing comprises a floor disposed adjacent to the bottom side of the housing, the floor comprising a pair of slots that receive the lever plates.

5. The first electrical connector body of claim 1 comprising an electrical connector housing that carries the set of electrical connectors, the electrical connector housing extending outwardly beyond the bottom side of the housing.

6. The first electrical connector body of claim 1 wherein when the lever moves from the extended position to the retracted position one or both of the lever plates engage the top wall to define the retracted position of the lever and to resist further rotation of the lever away from the extended position.

7. The first electrical connector body of claim 1 wherein the lever plates form a portion of a U-shaped member open towards the back end of the housing when the lever is in the retracted position.

8. The first electrical connector body of claim 1 wherein each side wall has a cutout adjacent the lever handle when the lever is in the retracted position.

9. The first electrical connector body of claim 1 wherein the lever rotates about 90 degrees between retracted and extended positions.

10. The first electrical connector body of claim 1 wherein the housing comprises a pair of trunnion bearings and the lever comprises a pair of trunnions received in the trunnion bearings and supported on said trunnion bearings.

11. The first electrical connector body of claim 10 wherein the lever trunnions and the trunnion bearings are sized to cooperatively define an interference fit that assists in retaining the trunnions in the trunnion bearings.

12. The first electrical connector body of claim 10 wherein the lever trunnions are received in holes formed in the side walls.

13. The first electrical connector body of claim 1 wherein the said at least a portion of the peripheral surfaces of the lever plates are not concentric with the pivot axis.

14. The first electrical connector body of claim 1 in combination with a second electrical connector body, the second electrical connector body comprising a housing that houses a set of the other of the male or female connectors;

the first and second electrical connector bodies being engageable with one another when the lever is in the retracted position and forming electrical connections between the sets of electrical connectors when so engaged;

when the first and second electrical connector bodies are engaged with one another and the lever is rotated from the retracted position to the extended position, the lever plates push against the second electrical connector body and apply a force to the second electrical connector body urging the first and second electrical connector bodies apart from one another.

15. The combination of first and second electrical connector bodies of claim 14 wherein:

the set of male connectors have an insertion depth into the set of female connectors when the first and second electrical connector bodies are engaged with one another;

and the first and second electrical connector bodies become spaced apart a distance less than the insertion depth after the lever is rotated from the retracted position to the extended position to move the engaged connector bodies apart and thereby partially, but not fully, separate the engaged first and second connector bodies.

16. The combination of first and second electrical connector bodies of claim 15 wherein the sets of male and female connectors move along a separation direction during separation of the first and second connector bodies; and the lever axis is substantially parallel with the separation direction when the lever axis is in the extended position.

17. The combination of first and second electrical connector bodies of claim 16 wherein when the lever is in the extended position the lever handle is at least partially outside of the first electrical connector body housing.

18. The combination of first and second electrical connector bodies of claim 14 wherein the lever plates are shaped to separate the first and second connector bodies at a non-constant rate with constant angular displacement of the lever from the retracted position to the extended position.

19. The combination of first and second electrical connector bodies of claim 18 wherein the lever plates are shaped to accelerate the separation of the first and second connector bodies with constant angular displacement of the lever from the retracted position to the extended position.

20. The combination of first and second electrical connector bodies of claim 14 wherein the lever plates engage the housing of the second electrical connector body during rotation of the lever from the retracted position to the extended position when separating the engaged first and second electrical connector bodies.

21. The combination of first and second electrical connector bodies of claim 14 wherein the lever plates extend into the housing of the second electrical connector body and apply force to a portion of the second electrical connector body within the housing of the second electrical connector body when separating the first and second electrical connector bodies.

22. The combination of first and second electrical connector bodies of claim 14 comprising a cable access opening in the housing of the first electrical connector body.

23. The combination of first and second electrical connector bodies of claim 22 wherein the set of electrical connectors of the first electrical connector body is a terminal block having electrical terminals, the electrical terminals connected to a cable extending through the cable access opening.

* * * * *